US008453744B2

(12) United States Patent
Buss et al.

(10) Patent No.: US 8,453,744 B2
(45) Date of Patent: Jun. 4, 2013

(54) DOWNHOLE MODULATOR APPARATUS

(75) Inventors: John Buss, Sandvika (NO); Charles William Donkin, Well (GB); Ian Hitchcock, Reading (GB); William Peter Stuart Bruges, Newbury (GB); Roy Mowatt, Hayes (GB); James Ratcliffe, Reading (GB); Anthony Webb, Woodley (GB)

(73) Assignee: Sondex Wireline Limited, Yately, Hampshire (GB)

( * ) Notice: Subject to any disclaimer, the term of this patent is extended or adjusted under 35 U.S.C. 154(b) by 386 days.

(21) Appl. No.: 12/621,169

(22) Filed: Nov. 18, 2009

(65) Prior Publication Data

US 2010/0126711 A1 May 27, 2010

(30) Foreign Application Priority Data

Nov. 19, 2008 (GB) ..... 0821177.3

(51) Int. Cl.
*E21B 34/00* (2006.01)
*E21B 34/06* (2006.01)

(52) U.S. Cl.
USPC ..... 166/316; 166/373

(58) Field of Classification Search
USPC ..... 166/66.7, 192, 202, 316, 373; 73/152.36, 73/155
See application file for complete search history.

(56) References Cited

U.S. PATENT DOCUMENTS 1,979,802 A * 11/1934 Kinley ..... 166/192
2,642,141 A 6/1953 Kolb
2,652,118 A * 9/1953 Hartman et al. ..... 166/202
2,672,200 A * 3/1954 Patterson ..... 166/123
2,691,418 A 10/1954 Connolly
3,119,451 A * 1/1964 Hall ..... 166/202
3,431,974 A * 3/1969 Bruecher et al. ..... 166/136

(Continued)

FOREIGN PATENT DOCUMENTS

EP 0428422 A2 10/1990
WO 99/49180 9/1999
WO 01/92681 12/2001

OTHER PUBLICATIONS

FR Search Report and Written Opinion dated Dec. 18. 2012 from corresponding FR Application No. 0958133.

*Primary Examiner* — Giovanna Wright
*Assistant Examiner* — Michael Wills, III
(74) *Attorney, Agent, or Firm* — GE Global Patent Operation

(57) ABSTRACT

A modulator is disclosed for creating a pressure pulse in a fluid-filled well. The modulator comprises a tool body on which a plurality of extendable arms are mounted. The arms may be retracted into a stowed position substantially adjacent the tool body, or may be extended to meet the wall of the borehole. The arms are preferably resilient bowsprings that may be flexed outwards from the tool by means of an actuator pushing on at least one end of the springs. A flexible valve sleeve or bag is suspended between the arms and cooperates with a valve mounted adjacent the sleeve on the tool body. The valve sleeve creates a fluid-flow path through the valve, and in operation, the valve closes one end of the valve sleeve to create the pressure pulse. Sealing of the valve sleeve against the wall of the well is a result of the fluid pressure inflating the sleeve against the well wall. As a result, sealing takes place over an extended area of the bag and is dynamically responsive to changes in fluid flow or pressure.

23 Claims, 11 Drawing Sheets

U.S. PATENT DOCUMENTS

| | | | | | |
|---|---|---|---|---|---|
| 3,601,188 | A | * | 8/1971 | McGlamery | 66/351 |
| 3,623,550 | A | * | 11/1971 | de Lajarte et al. | 166/125 |
| 3,942,374 | A | | 3/1976 | Glenn, Jr. | |
| 4,452,076 | A | * | 6/1984 | Gavignet et al. | 73/152.36 |
| 4,576,042 | A | | 3/1986 | Johnson | |
| 4,671,356 | A | * | 6/1987 | Barker et al. | 166/285 |
| 5,052,220 | A | * | 10/1991 | Piers | 73/152.36 |
| 5,667,015 | A | | 9/1997 | Harestad et al. | |
| 6,454,001 | B1 | * | 9/2002 | Thompson et al. | 166/250.14 |
| 6,739,391 | B2 | * | 5/2004 | McMahan | 166/153 |
| 6,951,262 | B2 | * | 10/2005 | West | 181/105 |
| 7,059,410 | B2 | * | 6/2006 | Bousche et al. | 166/296 |
| 2009/0301784 | A1 | * | 12/2009 | Hall et al. | 175/269 |

* cited by examiner

DOWNHOLE MODULATOR APPARATUS

CROSS-REFERENCE TO RELATED APPLICATIONS

This application claims priority under 35 U.S.C. §119(a)-(d) or (f) to prior-filed, co-pending Great Britain patent application number 0821177.3, filed on 19 Nov. 2008, which is hereby incorporated by reference in its entirety.

BACKGROUND OF THE INVENTION

Field of the Invention

This invention relates to a downhole modulator apparatus for use in a borehole, and in particular to a downhole modulator apparatus for use with borehole logging equipment provided as a tool string.

In order to measure the properties of an oil, water or gas well, one or more sensing or measurement tools may be deployed in the well to make measurements in situ. This may occur during drilling operations or during operation of the well. Typically, several different measurement tools are required, each tool specialising in a single type of measurement. Such measurements can include measurement of the velocity and direction of fluid flow in the well, measurements of capacitance and/or resistance for determining the fluid composition, and measurement of the local well bore fluid pressure for example. Where several tools are required, the tools are often connected together into a tool string that may be positioned in the well by means of a wireline. As well as allowing the allowing the tool string to be manoeuvred in the well, the wireline typically carries electrical power and/or telemetry signals for controlling and monitoring the respective tools.

The tool string also typically comprises additional equipment for the downhole environment, such as one or more centralisers to support the tool string in the centre of the well's diameter, signalling equipment, such as mud pulsers or modulators, well casing perforators, shock absorbers, and often one or more anchors for securing the tool string at a desired position in the well while any measurements are made.

A modulator is an apparatus that can be used to introduce pressure pulses into the fluid of the borehole. Modulators can be used for downhole to surface signalling, and can also be used in sensing techniques for determining the quality of an oil reserve in the borehole.

One example of a known method and device for determining the quality of an oil well involves modulating the fluid flow in the well with a cyclical pressure function. Variations in flow rate and pressure of the fluid are then measured with a flow meter and a pressure sensor to determine the well quality.

A number of modulator embodiments for slowing the flow of fluid in the well are also known, including a propeller like arrangement, a device having several retractable vanes that can be extended to block the flow of fluid in the borehole, and a toroidal elastomeric sack that fits around the tool and that can be pressurised to expand and seal against the casing wall.

Known modulators of these kinds suffer from a number of drawbacks. Embodiments comprising propellers or vanes typically cannot block the flow of fluid sufficiently for the modulation scheme to be effective. They further presuppose that the internal diameter of the borehole is known in advance, so that when deployed both propeller and vanes can physically block enough of the cross-section of the borehole to have a modulation effect. Without knowing the diameter of the borehole in which the vane-based modulator is to be deployed it is extremely difficult to ensure adequate sealing between individual vanes and between the vanes and borehole inner surface. Toroidal sacks or bladders on the other hand have been found to oscillate when they are close to sealing against the wall of the borehole, which can seriously affect the modulation scheme. They also require a large fluid reservoir to be housed in the tool to pressurise the bladder for use. All such devices must further be contained within a small lateral cross-section of the tool, so that the modulator tool can be easily deployed and retrieved from a borehole without damaging the borehole or the tool.

We have therefore appreciated that there is a need for a modulator device that can operate across a range of borehole diameters, and that can be easily stowed into a narrow cross section for deployment and retrieval. We have also appreciated that there is a need for a modulator device that can provide a sufficiently strong seal so the device can operate in a range of fluid flow rates and pressures.

SUMMARY OF THE INVENTION

The invention is defined in the independent claims to which reference should now be made. Advantageous features are set out in the dependent claims.

In a first aspect of the invention, there is provided an apparatus for downhole use in a fluid-filled well, the apparatus comprising: a longitudinal tool body; a plurality of extendable arms mounted on the tool body for opening and closing within the fluid-filled well; a flexible valve sleeve attached to the plurality of extendable arms and moveable between a stowed position and an unstowed position by movement of the extendable arms, wherein in the unstowed position the valve sleeve is arranged to receive a flow of fluid from the well and the pressure of the fluid in the valve sleeve causes at least a portion of the valve sleeve to seal against a wall of the well.

In a further aspect of the invention, there is provided a modulator apparatus for downhole use in a fluid-filled well, the modulator comprising: a longitudinal tool body; a plurality of extendable arms mounted on the tool body for opening and closing within the fluid-filled well; a flexible valve sleeve attached to the plurality of extendable arms and moveable between a stowed position and an unstowed position by movement of the extendable arms, wherein in the unstowed position the valve sleeve is arranged to receive a flow of fluid from the well and the pressure of the fluid in the valve sleeve causes at least a portion of the valve sleeve to seal against a wall of the well; and a valve for modulating the pressure of the fluid in the fluid-filled well by at least partly closing one end of the valve sleeve to restrict the flow of fluid.

In a further aspect of the invention, there is provided a modulator apparatus for downhole use in a fluid-filled well, the modulator comprising: a tool body; a valve for modulating the pressure of the fluid in the fluid-filled well, the valve having a valve seat disposed on the tool body and one or more valve members for closing against the valve seat; and a retractable fluid flow channel for at least partly sealing against the wall of the fluid-filled well and for channeling the fluid in the fluid-filled well to the valve.

BRIEF DESCRIPTION OF THE DRAWINGS

Preferred examples of the invention will now be described by way of example and with reference to the drawings in which.

DETAILED DESCRIPTION OF THE PREFERRED EMBODIMENTS

A preferred example of a modulator apparatus according to the invention will now be described with reference to the Figures.

The example modulator comprises a tool body on which a plurality of extendable arms are mounted. The arms may be retracted into a stowed position substantially adjacent the tool body, or may be extended to meet the internal surface of the well such as the well wall or casing. The arms are preferably resilient bowsprings that may be flexed outwards from the tool by means of an actuator pushing on at least one end of the bowsprings. A flexible valve sleeve or bag is suspended between the arms and cooperates with a valve mounted adjacent to the sleeve on the tool body. The valve sleeve creates a fluid-flow path through the valve. In operation, the valve closes one end of the valve sleeve to create a pressure pulse. Sealing of the valve sleeve against the wall of the well is a result of the fluid pressure inflating the sleeve against the well wall.

As a result, sealing takes place over an extended area of the bag and is dynamically responsive to changes in fluid flow or pressure.

Figure 1:
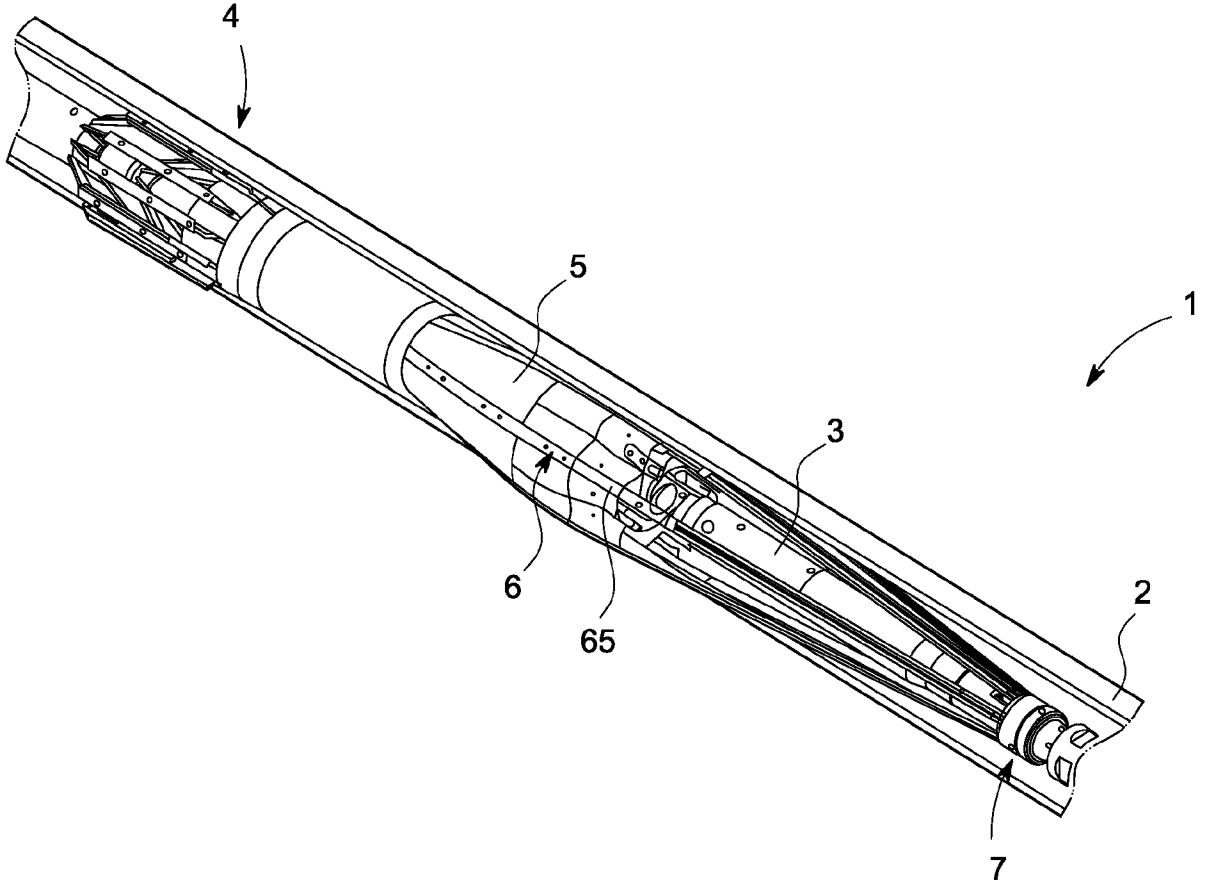
FIG. 1 is an isometric view of the modulator apparatus in a first example.

FIG. 1 is an isometric view of the modulator apparatus 1 shown in situ in a borehole 2. The borehole 2 is shown in a cut-away view, and the edge of the borehole casing 2 is visible. The modulator apparatus 1 comprises a central rod or mandrel 3 for connection to adjacent components in the tool string by known attachment means (not shown here). In practice, the tool string may be of the order of 30 feet, around 9 m, long, with a tool body diameter of around 1 11/16" or 4.25 cm. These dimensions are not intended to be limiting, but are given merely by way of example. A valve 4 is mounted on the mandrel 3 adjacent a flexible valve membrane or sleeve 5 which is supported on a plurality of bowsprings 6. The valve membrane 5 is for sealing against the inside of the borehole 2 and is an important part of the modulator. In FIG. 1 the valve membrane 5 is visible, but in FIG. 2 the membrane is omitted so that the underlying details of the apparatus can be seen.

The number of bowsprings 6 may depend on the particular embodiment but is typically between six and twelve. Six bowsprings are usually employed for convenience, but in alternative embodiments, less than six or more than twelve bowsprings could be employed according to need. Further, in alternative embodiments, where bowsprings are not used, the extendable arms may be vanes or arms that are provided at a location on the tool by means of a mount or pivot for example, and which can be controlled to extend and retract under the influence of a suitable actuator mechanism.

The plurality of bowsprings 6 are mounted on the mandrel at spaced apart first and second mounts or attachment points 7 and 8. The attachment points for the bowsprings 6 are spaced more closely together than the length of the bowsprings, so as shown more clearly in FIG. 2, that the bowsprings 6 can be flexed outwards in use to meet the internal casing of the borehole 2. The bowsprings 6 themselves are made of resilient metal so that they will be compressed on contact with any restrictions or changes in diameter of the casing of the borehole 2.

Figure 3:
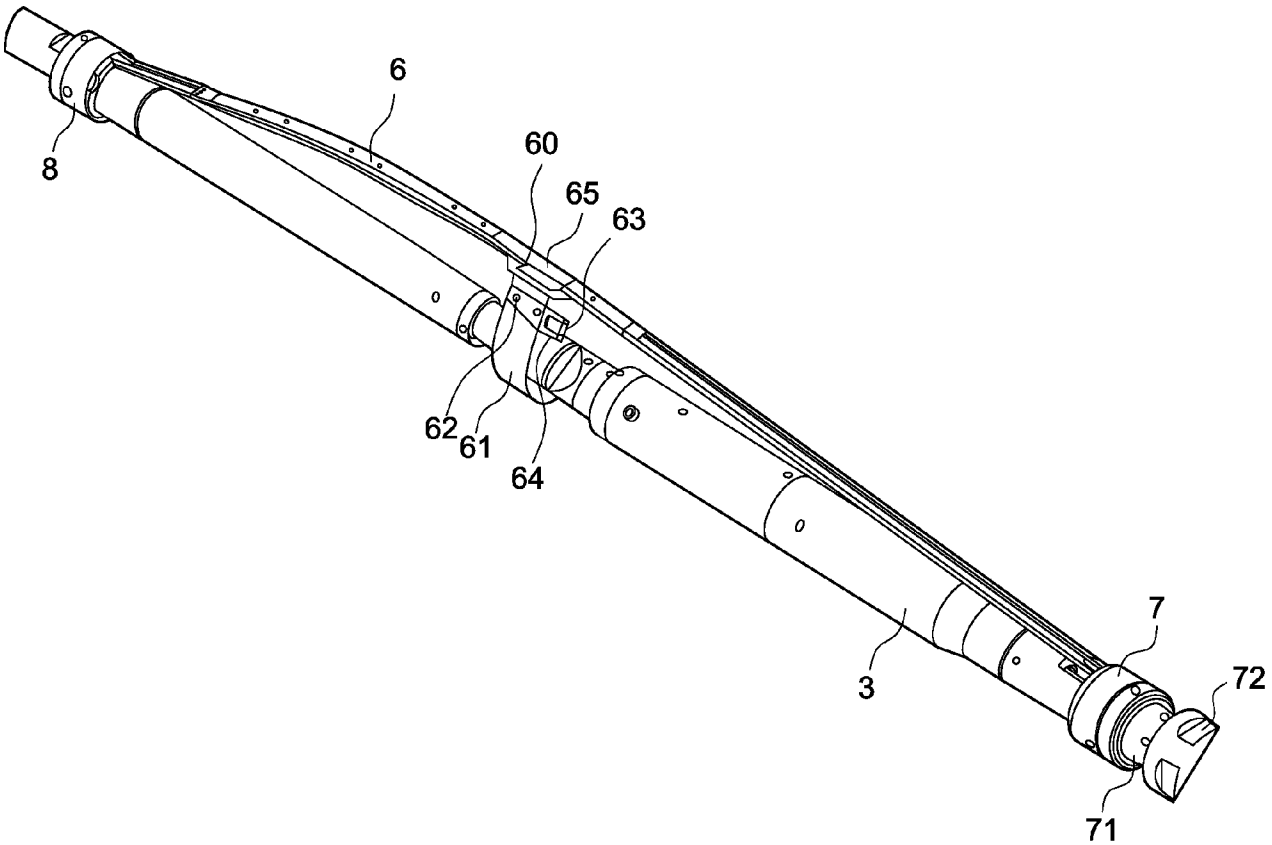
FIG. 3 is an isometric view of the mandrel and showing a single bowspring.

FIG. 3 is an isometric view of the central mandrel 3 showing only a single bowspring 6. In this example embodiment, connection point 8 is a fixed bush disposed on the mandrel 3. Connection point 7 however is not fixed but is moveable in a longitudinal direction along the axis of the mandrel 3. In this example, movable bush 7 is mounted on an actuable rod or piston 71 received in housing 72, which may be provided as part of the central mandrel 3.

Actuator rod 71 may be controlled by an actuator (not shown) to extend from or retract into the housing 72 by means of control signals sent from a controller by means of the wireline, or alternatively by wireless signals. Movement of the actuator rod 71 decreases or increases the distance of the moveable bush 7 from the fixed bush 8 allowing the lateral extension of the bowsprings 6 to be controlled.

The moveable bush 7 has a maximum extended position in which it is closest to the fixed bush 8, and the bowsprings 6 are flexed outwards against the borehole casing 2 by means of the longitudinal compressive force applied by the bushes 7 and 8. It also has a stowed or closed position in which the movable bush 7 is moved away from the fixed bush 8 to its maximum extent so that the bowsprings 6 and valve membrane 5 are pulled flat against the mandrel 3 for storage. In operation, the movable bush 8 may be at any position between the two extreme positions.

Figure 4:
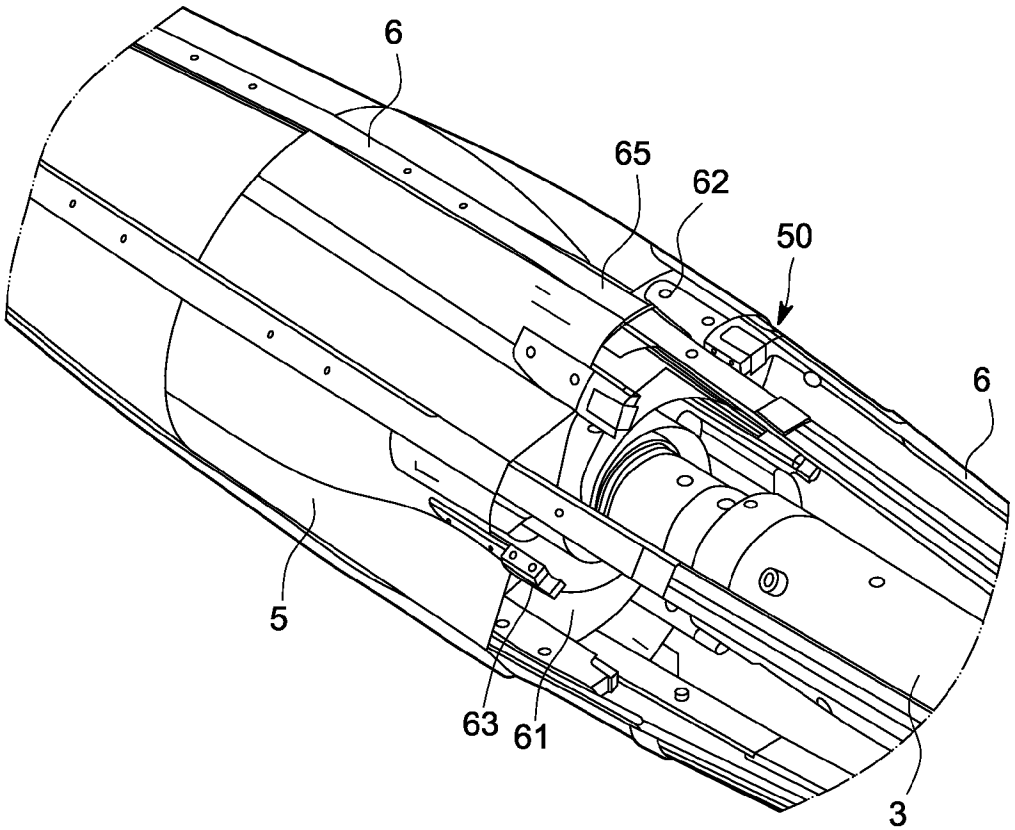
FIG. 4 is an enlarged isometric drawing of the edge of the valve membrane showing in detail its attachment to the bowsprings.
Figure 5:
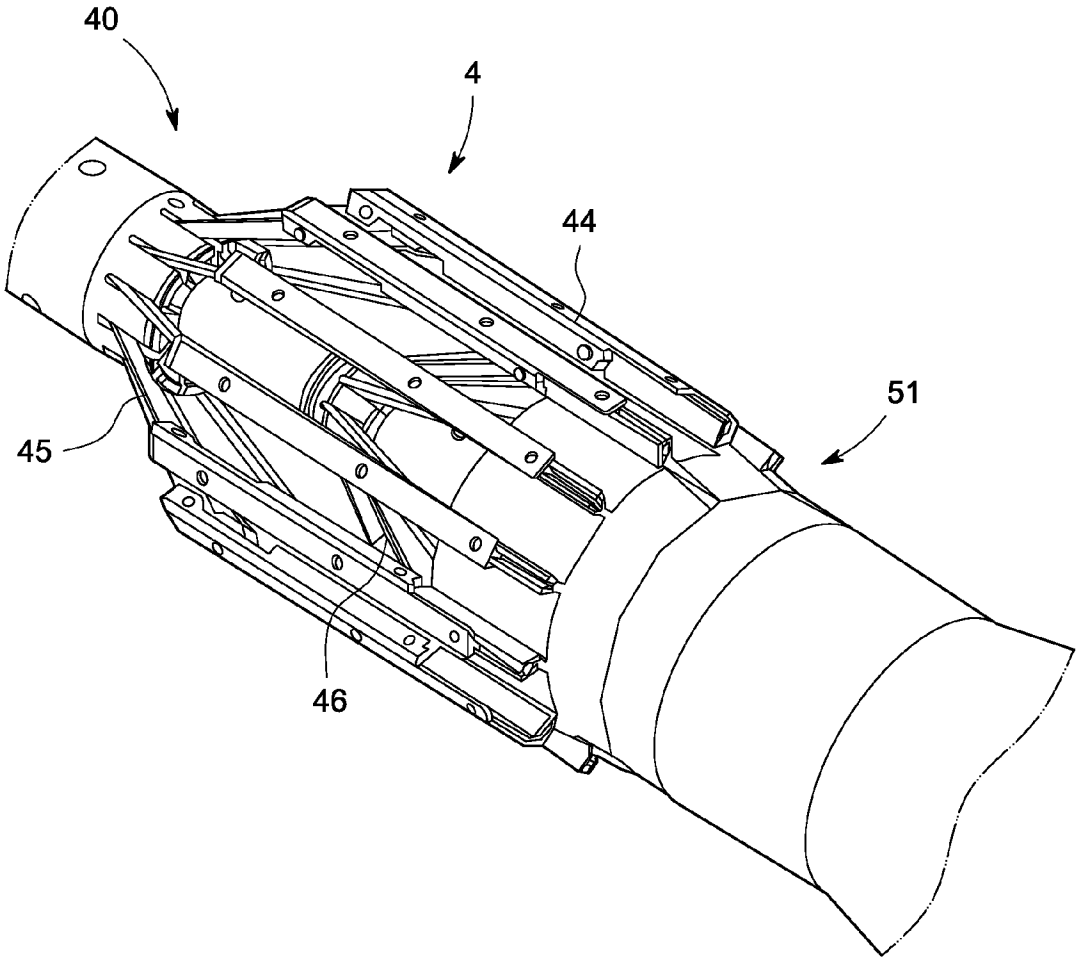
FIG. 5 is an isometric drawing showing the valve in an open position.

Referring to FIGS. 4 and 5, the valve membrane has an upstream end 50, which in operation is angled into the fluid flow in the borehole as well as a downstream end 51, attached to the valve 4. The valve membrane 5 may be made of fabric, such as an aramid or similar fabric. Kevlar is one example. The fabric may also be a non-porous weave, or may be coated or doped with PTFE, PEEK or other non-porous substance, and may be manufactured either as a single piece or as a combination of separate pieces that are sewn, welded, bonded or otherwise securely attached in a leak proof manner. It has been found preferable to manufacture the valve membrane in at least two sections. The first section for sealing against the inner surface of the borehole, is essentially tapered or conical in shape but is truncated at one end, to be frusto conical, much like a windsock. It is advantageous to keep the angle of the conical section small, such that the sealing forces are made larger. The second section is substantially cylindrical or tubular and is for cooperating with the valve member 4. The two sections are attached together such that they are coaxial and such that any fluid flowing into the larger diameter of the windsock continues to pass through the narrow diameter of the windsock into the tubular section. The windsock portion of the valve membrane is supported on the bowsprings 6.

The valve sleeve 5 is essentially a tube with a diameter at one end that is larger than the largest diameter to be sealed, and at the other a diameter that is smaller than the smallest diameter to be sealed. It follows that between the large and small diameters there is one diameter which corresponds exactly to the inside diameter of the casing. Given that the inside diameter of the sleeve is pressurised by the flow, this diameter substantially seals any flow between the casing and the membrane. It also means that the inside casing of the well need not be circular, as the sleeve will adapt to minor variations in shape.

As shown in FIGS. 3 and 4, each bowspring 6 may comprise a laterally extending bracket 60, located approximately half way along the length of the bowspring 6, at a location close to where the edge of the valve membrane 5 will be located, when the tool is assembled. The bracket 60 may be formed integrally to the bowspring 6, or be formed separately and subsequently welded to it. The bracket 60 itself receives a constant force spring 61. One end of the constant force spring 61 is threaded through the bracket 60 and bent back on itself to hold it in place, and the other end, referred to here as the anchor end, is curled around the central mandrel 3.

In the example embodiment described here, the constant force spring 61 is a strip of spring steel about 0.2 mm thick, 25 mm wide and 300 mm long, formed into a coil of about 20 mm inside diameter such that its natural position is to be in a wound condition. The strips can be coupled to the mandrel 3, by means of a bobbin (not shown), rotatably mounted on the tool, about the tool's longitudinal axis. The anchor ends of the constant force springs 61 are wound around the same bobbin by taking the springs, laying them flat against one another and letting the springs wind up such that they are interlaid with a common axis. Rotation of the bobbin winds or unwinds each constant force spring 61 by a constant amount, ensuring the bowsprings 6 move radially inwards and outwards from the mandrel 3 in synchronisation. The constant force springs are prestressed so that they are biased towards closing around the central mandrel.

The mechanism for attaching the valve membrane 5 to the bowsprings 6 will now be explained in more detail, with reference to FIGS. 3 and 4. Secured to the each constant force spring 61 by fasteners 62 is a clip assembly 63. The fasteners 62 are preferably pins that pass through corresponding holes in the constant force spring 61 and the valve membrane 5 in order to provide a secure attachment.

In this example the clip assembly 63 comprises a hinge 64 that enables the clip assembly 63 to be fastened over the constant force spring 61 and the edge of the valve membrane 5 clamping them to one another. The hinge may be secured with a screw (not shown) to hold it in place.

The pins 62 allow the clip assembly 63 to be easily detached from the valve membrane 5 should repair of a particular component, such as the valve membrane 5 itself, be required. In alternative examples other types of fasteners or adhesives may be used.

The clip assembly 63 is located a small distance along the constant force spring 61 from its attachment point at bracket 60, so that it secures the valve membrane 5 to the constant force spring 61 at an intermediate point between the bowsprings 6 and the bobbin mounted on the mandrel. In this way, billowing of the edge of the valve membrane 5 intermediate the springs is greatly reduced, and when the bowsprings 6 are pulled towards the mandrel 3 by means of the movable bush 7, the edge of the valve membrane 5 is tucked in and around the mandrel 3 so that it can be neatly stowed. The significance of this will be discussed in more detail later.

Referring now to FIGS. 1 and 4, it will be seen that the valve membrane 5 is also attached directly to the bowsprings 6, by means of securing strips 65. The securing strips are releasably attached to the bowspring 6 by means of cooperating bayonet pins and elongated tapered slots. The pins are inserted into a wider portion of the slots to make a tentative connection and then slid towards a narrower portion to make the connection hold. Clips on the bowspring 6 or securing strip 65 lock the two pieces in place. Both the bowspring 6 and the securing strips 65 are therefore formed with a flattened profile so that they can engage and slide across one another in stable fashion.

To attach the valve membrane 5 to the bowsprings 6, the valve membrane 5 is passed over the bowsprings 6 and under the securing strips 65 before they are slotted into place. Holes are provided in the valve membrane 5 to receive the bayonet pins of one or the other of the bowspring 6 or securing strip 65. Thus, the valve membrane 5 is secured to each bowspring 6 along much of its length improving the sleeve's resistance to bagging under the pressure of the fluid in the well. Such an arrangement minimises the number of screws required and makes removal of the sleeve and bowsprings in the event of repair extremely easy to achieve.

Furthermore, the bowsprings 6 comprise a small ridge or protrusion (not visible in the drawings), distant from the periphery of the valve sleeve 5, that is arranged when stowed to fit under an adjacent bowspring 6 when the bowsprings 6 are closed. The protrusion acts on the area of valve sleeve 5 between bowsprings 6, when the bowsprings 6 are closed, and thereby forces a crease in the membrane 5. This assists the stowing of the part of the membrane 5 that is distant from the membrane periphery in tucking around the mandrel 3 in a neat fashion, and avoids damage to the sleeve and reduces the risk that the sleeve will rip and need replacing.

The valve 4 will now be discussed in more detail with reference to FIGS. 2 and 5. The valve 4 comprises a first and second bushes 40 and 41 mounted on the mandrel 3, adjacent a third bush that forms a valve seat 42. A plurality of articulated valve members 43, in this case twelve, extend outwards from the first bush 40, in a radial arrangement around the mandrel 3.

Figure 2:
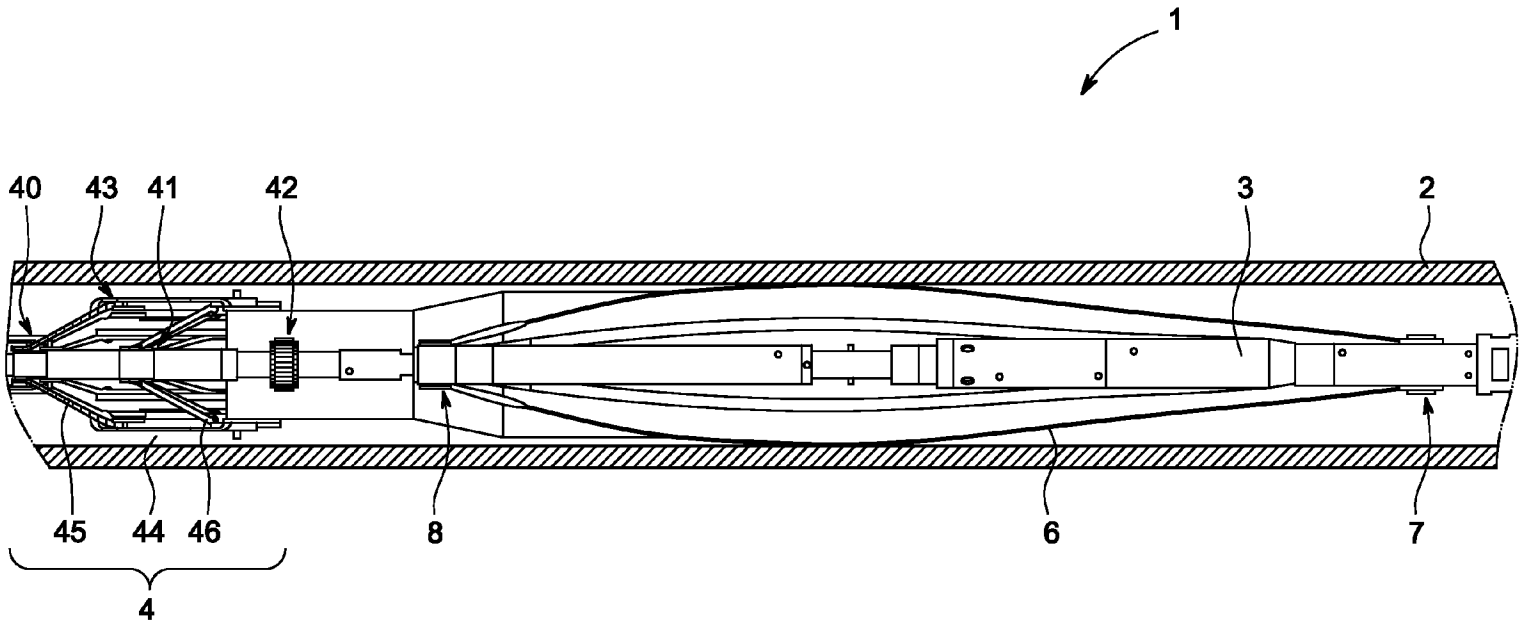
FIG. 2 is a side elevational view of the modulator apparatus of FIG. 1.

As illustrated most clearly in FIG. 2, the articulated valve members comprise a closing member 44 or clamp that is maintained in an orientation substantially parallel to mandrel 3 by means of first 45 and second 46 leg members pivotally mounted on respective ones of the first 40 and second 41 bushes. In practice, the applicant has found it desirable to introduce a slight inwards curve in the closing members 44, as there is a normal tendency for them to bow outwards due to the forces acting on the downstream end of the membrane 5. This slight curvature improves the interaction of the closing members 44 with the valve seat 42.

As shown in FIG. 5, end of each of the closing members 44 is attached to the opposite end 51 of the valve membrane 5. When the valve is closed as illustrated in FIGS. 7 and 8, the valve membrane 5 is pressed against the valve seat 42 thereby substantially sealing the end 51 of the valve membrane 5.

Figure 6:
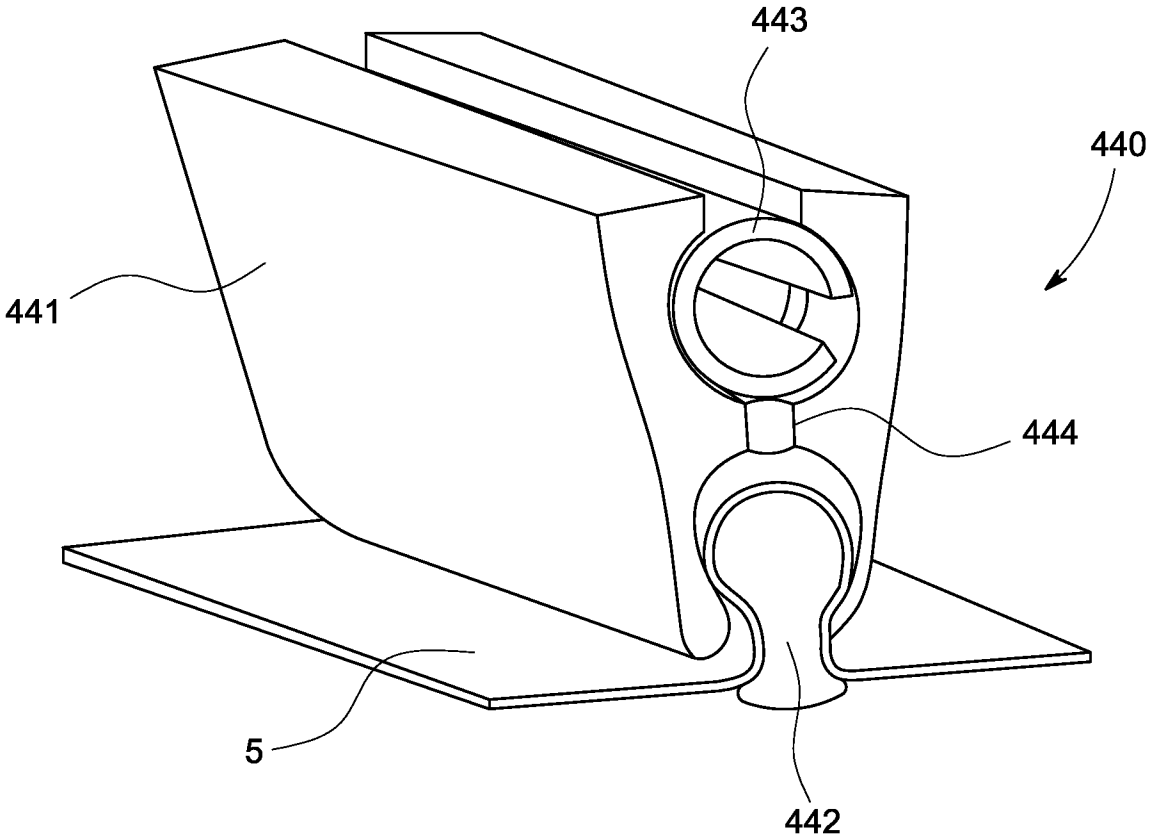
FIG. 6 is an isometric view of a clamping mechanism for joining the valve to the valve membrane.

FIG. 6 shows in more detail the clamping mechanism 440 for attaching the valve membrane 5 to the closing members 44. The clamping mechanism works by trapping the fabric of the valve membrane 5 between the fabric clamp 441 and a key 442. The load force on the valve membrane is exerted by using a spring pin 443. The fabric clamp 441 is designed in an H profile, where the centre of the H 444 is allowed to flex such that expanding the upper part of the clamp with the spring pin forces the lower half to compress onto the key.

Figure 7:
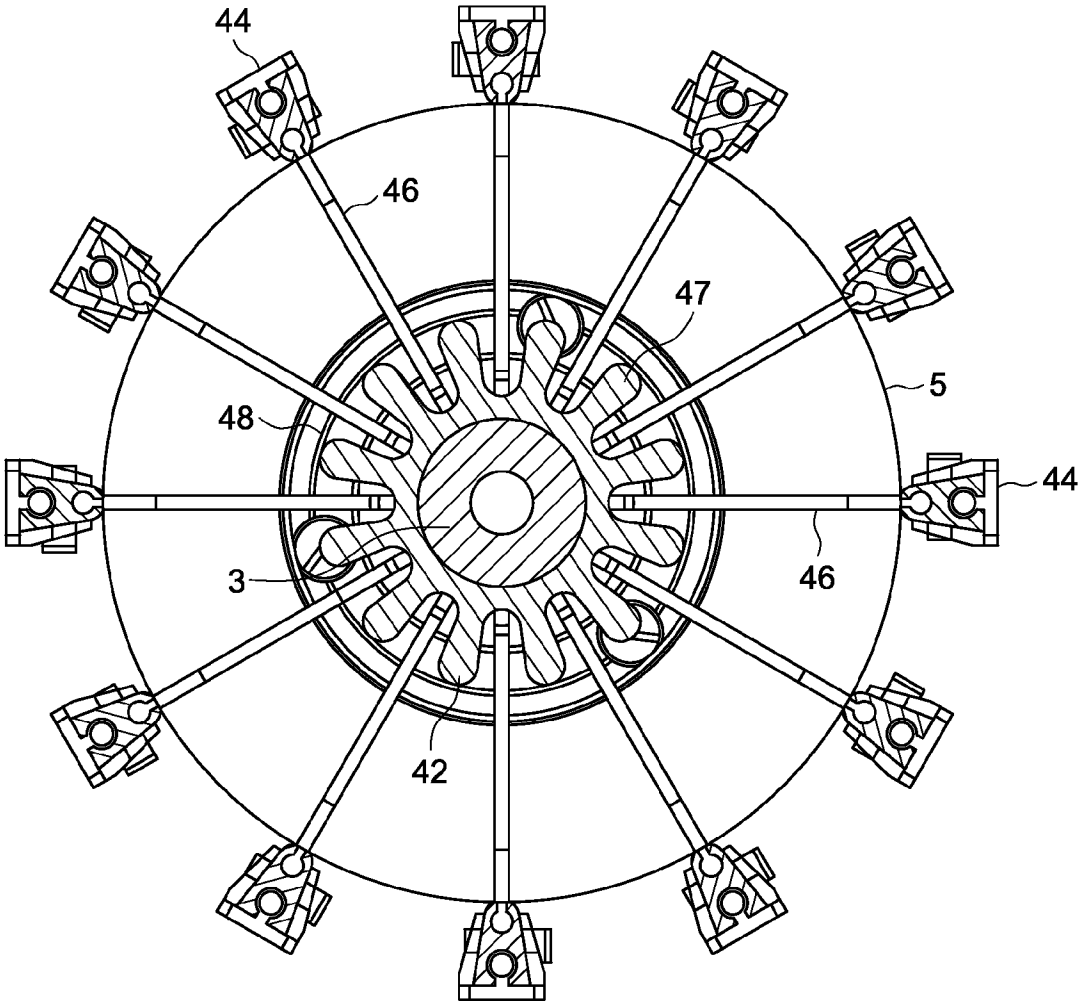
FIG. 7 is a lateral cross sectional view showing the valve in an open position.
Figure 8:
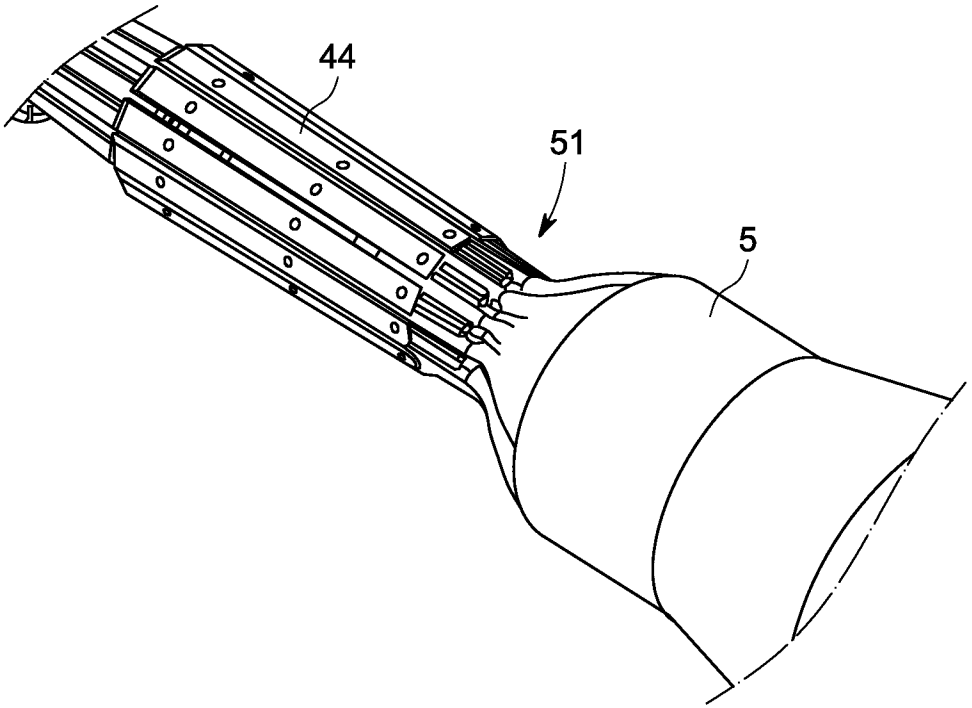
FIG. 8 is an isometric drawing showing the valve in a closed position.
Figure 9:
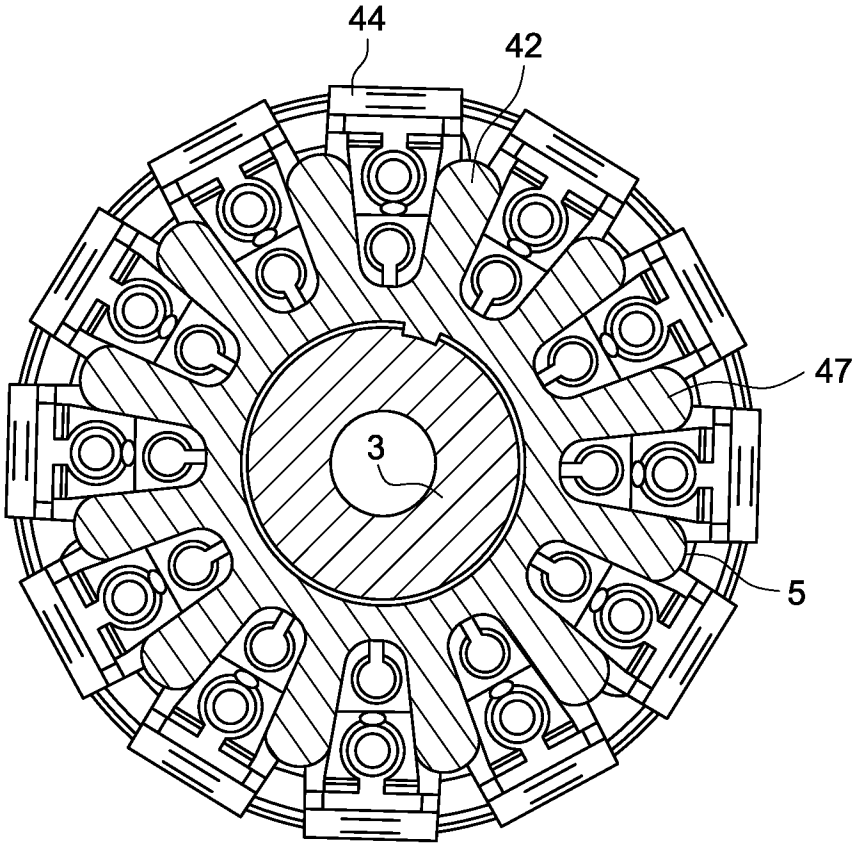
FIG. 9 is a lateral cross sectional view showing the valve in a closed position.

Referring now to FIGS. 7 and 9, valve seat 42 can be seen to have a number of longitudinal ridges for cooperating with the clamps. Valve seat 42 is shaped like a gear wheel with alternating protruding teeth or splines 47 and recesses 48 located around its circumference. The recesses are arranged opposite the valve members or clamps 44, and when the valve 4 is closed the side of the valve member is received into the recess 48. As shown more clearly in FIG. 9, both the side of the valve member 44 and the recess 48 are tapered in complimentary fashion so that the closing members 44 can be received in the recesses 48 easily, while still making a good seal. The closing members 44 and the recesses 48 do not however fit exactly and enough room is left between them to accommodate the valve membrane 5.

In the example embodiment, the valve seat is preferably made of an elastomer like rubber, or another elastic or hyper-elastic material, as this assists the valve 4 in forming a good seal. Should the periphery of the valve membrane 5 be slightly too large for example, the closing members force the valve membrane 5 material into the recesses 48 to create the seal. If, on the other hand, the periphery of the valve membrane 5 is too short, then the splines 47, by virtue of being formed in a rubber or elastic material, are compressed slightly into the recesses 48, and again create a good seal.

In FIG. 7 the valve membrane 5 is represented by the circular line threading each of the closing valve members. In FIG. 9, which shows the valve 4 in a closed position, the valve membrane 5 is shown pressed against the teeth 47 and recesses 48 and essentially adopting their shape. In practice a force of about 100 to 150 N has been found necessary to generate a seal membrane with a circumference of around 6 mm. The valve 4 is controlled and moved between its open and closed positioned by means of an actuator located in the first or second bushes 40 and 41. The actuator receives signals via the wireline to control the valve as desired. In a preferred embodiment, the actuator is a moveable sleeve mounted on a linear motor which operates to force the first and second leg members between the open and closed positions.

The valve mechanism described is particularly advantageous as it is small and robust, and allows convenient replacement of the membrane 5 for repair or such that a membrane 5 that is appropriate to the size of well or casing can be fitted. It also grips the membrane securely, allowing the appropriate pressure forces to be exerted without destroying or damaging the membrane.

Additionally, the valve mechanism provides predictability. As the deformation of the elastomer valve seat can be calculated, it can be confirmed in advance that a good seal will be formed. Additionally, the actuator can be used both for sealing and for modulation.

Figure 10:
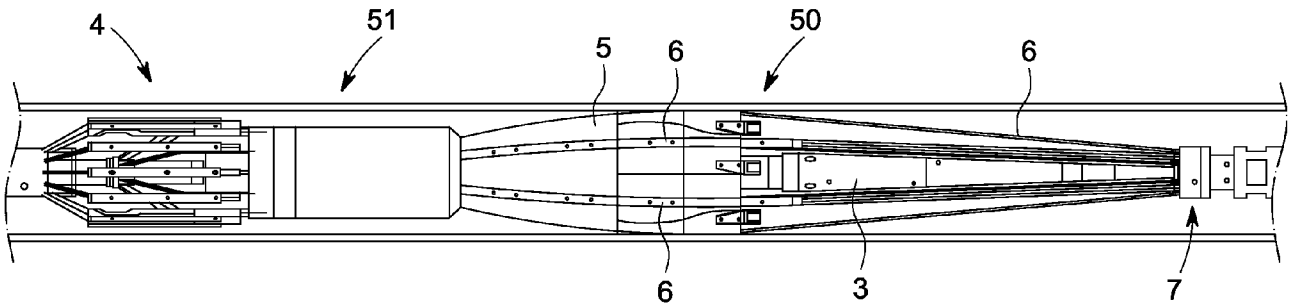
FIG. 10 is a side elevational view of the modulator apparatus showing the valve in an open position.
Figure 11:
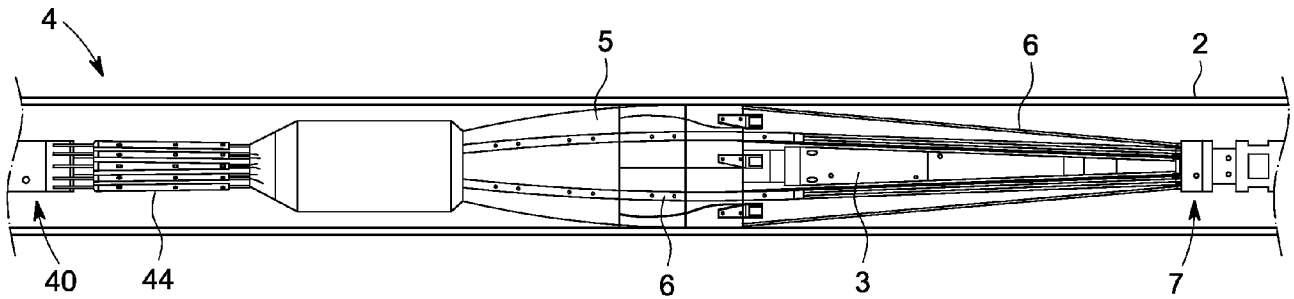
FIG. 11 is a side elevational view of the modulator apparatus showing the valve in a closed position.

The operation of the device will now be described in more detail with reference to FIGS. 10 and 11. The modulator apparatus is deployed in the borehole environment by means of the wireline and tool string so that the valve 4 is in the downstream direction and the valve membrane 5 is upstream facing into the flow of borehole fluid.

During deployment, the moveable bush 7 is pulled away from the fixed bush 8 so that the bowsprings 6 are stretched and lie substantially flat against the mandrel 3. As the bowsprings 6 are drawn in towards the mandrel from an extended position, the constant force springs 60 slide around the mandrel 3 on the bobbin picking up the slack in the valve membrane 5. As they do so, the hinged clips 63, mounted on the constant force springs 60 and the valve membrane 5, tuck the membrane 5 around the mandrel 3 so that it is unlikely to protrude and be ripped or otherwise damaged. The flanges located further along the bowsprings 6 from the edge of the valve membrane 5 provide a similar effect in the middle of the membrane 5.

Once the modulator has been deployed at the desired site, the moveable bush 7 is pushed by the actuator rod 71 towards the fixed bush 8 so that the bowsprings 6 are flexed outwards against the casing 2 of the borehole. If the borehole diameter is known in advance the actuator rod 71 may be moved by a predetermined amount so that the bowsprings 6 provide a predicted or known amount of force against the borehole casing. Otherwise, the actuator rod 71 may simply be moved towards the fixed bush 8 by the maximum amount possible without tripping the over-extension safety mechanism described below. As the bowsprings 6 are pushed outwards, the constant force springs 60 and valve membrane 5 unfurl so that they are fully opened in the borehole. Once the valve membrane 5 has begun to open the fluid pressure in the well acts to inflate the membrane 5 further assisting the opening movement.

Under normal operational conditions, fluids like a solution of water and hydrocarbons will flow through the borehole. With the valve membrane in an open or unfurled position, the fluid enters the upstream end 50 of the valve membrane, passes through the valve membrane 5 and, assuming the valve is open, exits through the downstream end 51 of the valve membrane and past valve 4 to continue its flow through the borehole.

The upstream end 50 of the valve 5 in its open position is larger in diameter than the downstream end 50 and as a result the pressure of the fluid flowing through the membrane causes it to inflate. The inflated membrane 5 is pressed against the casing of the borehole 2 by the pressure of the fluid and creates a seal that severely restricts the flow of fluid leaking around the valve membrane and along an external path past the valve 4. In practice, the efficiency of the seal has been found to be more than sufficient for modulator applications.

As the valve membrane 5 provides an extended, tapered flexible surface area, the actual point of sealing against the borehole casing can occur at any point on the membrane that can be brought into contact with the casing by means of the fluid pressure. This means that the sealing effect is responsive to the topical environmental conditions, such as pressure, borehole shape, modulator orientation, and bowspring extension. As the conditions change, the membrane adapts its position under the effect of the fluid pressure accordingly and the seal in maintained.

Use of the pressure of the fluid to effect the necessary seal means that the apparatus is working with the forces in the borehole rather than against them, and means that the valve membrane 5 can seal far more effectively than alternative arrangements suggested in the prior art.

The design of the valve membrane 5 and bowsprings 6 ensures that in practice a pressure difference across the deployed valve membrane of around 5 psi is achievable. The pressures in the well can be up to 15 000 psi. In slow-flowing wells this requires that the flow of fluid around the membrane 5 is limited to a trickle, while in fast flowing wells the flow is only blocked minimally.

In order to produce a pulse in the fluid of the borehole, the valve 4 is instructed to close against the valve seat 42. The closing of the valve 4 draws the downstream end 51 of the valve membrane 5 into a sealed position against the valve seat 42, thereby substantially cutting off the flow of fluid through the membrane 5. Sensors in the tool string may then measure the resultant changes in flow and pressure, and store them, or transmit them to the surface where they can be analysed in detail by suitable software.

In practice it has been found more accurate to cycle the valve 4 between two defined valve positions, open and closed for example, so that when measurements are being taken the results can be averaged and stability of the measurements confirmed. In particular, the phase difference and the amplitude ratio can be averaged over a number of cycles.

The closing of the valve can be fast or slow, and may take tens of seconds or an hour or more as required. The valve 4 need not be closed completely, as increasing the restriction at the down stream end of the valve membrane is sufficient to cause a detectable change in pressure at detection equipment.

As a result of the sealing provided by the valve membrane 5 against the borehole casing 2, the pulse provided by the modulator is of a better quality and the modulator can operate under a wide range of operating conditions. The modulator device described for example can work in nominal flows between 9000 bpd and 300 bpd, that is 16 pints/s to 1 pint/s, and can seal better than 1 pint/s.

Once the intended use of the modulator in the borehole is finished, the moveable bush 7 is retracted pulling the bowsprings 6 and valve membrane 5 towards the mandrel 3 and the stowed position. In this position, the modulator 3 can be pulled to the surface of the borehole by means of the wireline and withdrawn from the borehole without a significant risk of damage.

The modulator apparatus further comprises a safety mechanism for guarding against over-pressures on the valve membrane 5. In normal operation of the device, the pressure difference across the valve membrane 5 is arranged to be between 4 and 7 psi. The pressure is balanced by the sealing of the valve membrane 5 against the inner surface of the borehole 2 allowing some minimal flow of fluid around the valve membrane 5 into the downstream part of the borehole. However, if for any reason, the fluid pressure in the upstream part of the borehole were to increase, a substantial pressure difference could build up across the membrane, and damage the valve 4, the valve membrane 5 and even the tool itself. A safety mechanism which trips when the pressure exerted on the valve membrane 5 is too great is therefore provided, as will be described in more detail with reference to FIGS. 12 and 13.

The fixed bush 8 to which the downstream end of the bowsprings 6 is attached takes the form of a coaxial sleeve 81 fixed to the mandrel 3. The upstream end of the sleeve is received within a housing 82 mounted on an adjacent section of mandrel 83, and cooperates with a detent mechanism for holding the sleeve in place in the housing 82.

In this example, the detent mechanism comprises a groove 84 on the sleeve in which a canted coil spring 85 is accommodated. Canted coil springs 85 are unusual in that the compression force of the spring acts in a direction other than along the longitudinal axis of the spring. In this case, a canted coil spring 85 is chosen in which the compression force acts perpendicular to the longitudinal, circumferential axis of the spring, and the canted coil spring 85 is threaded around the central mandrel 3. Thus, the canted coil spring provides a force acting against the lip of the groove 84 to hold the sleeve 81 in place inside the housing 82. Canted coil springs are preferred because they are formed of metal and are therefore able to withstand the harsh operating conditions in the borehole over a long working lifespan. In alternative embodiments, resilient washers made of plastic or rubber based materials could alternatively be used.

Figure 12:
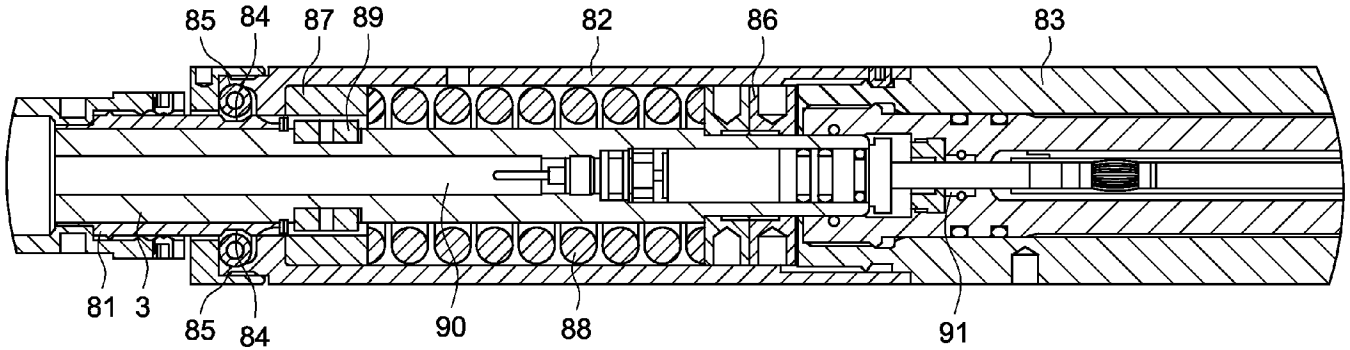
FIG. 12 is a longitudinal cross-section through the tool showing an over extension safety mechanism in a default position.
Figure 13:
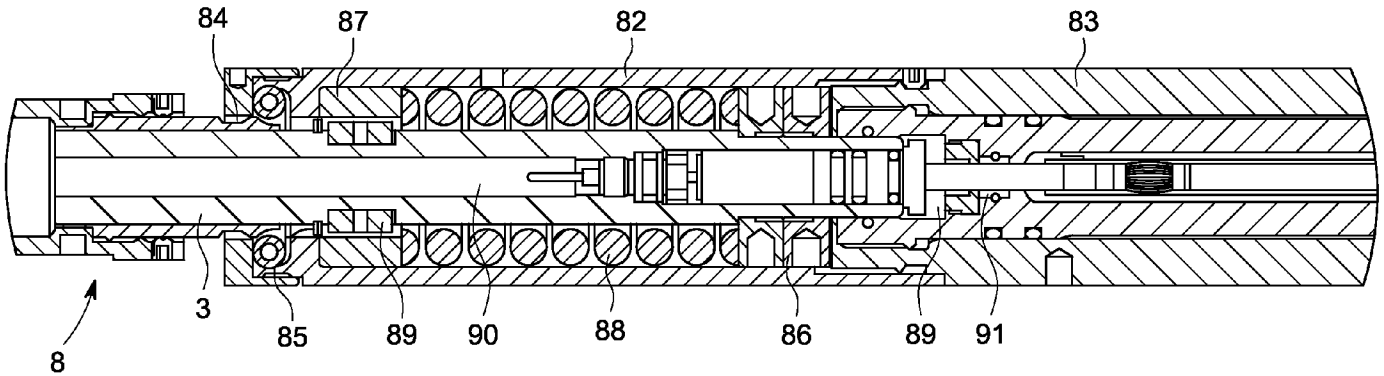
FIG. 13 is a longitudinal cross-section through the tool showing an over extension safety mechanism in a triggered position.

A presser-plate 86 is mounted on the mandrel 3 where it is received within the housing 82. The presser-plate acts 86 on the end of the adjacent mandrel section 83 to limit the movement of mandrel 3 in the housing 82. The mandrel 3 is however at partially received within a hole in the end cap of the mandrel 83 so that an electrical connection with the neighbouring portion of the tool can be made. The presser plate 87 also acts on spring 88, which at its other end is secured by shoulder 87. If the safety mechanism trips the mandrel 3 will move away from mandrel section 83, as shown in FIG. 12 compressing the spring 88, which thereby provides a restoring force to reset the mechanism at a later time.

A collar 89, mounted on the mandrel 3 prevents the mandrel rotating against the housing 82 and prevents twisting of the spring, and the wireline 90 which is threaded through mandrel 3 and adjacent mandrel section 83. The wireline 90 threaded through the centre of mandrel 3 and adjacent mandrel section 83 can be seen in FIG. 12. The section of wireline 90 in the adjacent mandrel section 83 passes through O-ring seal 91 and has some play in its length, so that movement of the mandrel section 3 can be accommodated.

If the pressure on the valve membrane 5 suddenly increases, an axial force will act on the valve membrane 5 and the bowsprings 6 to which it is connected, pushing them in the downstream direction. This pushes the bush 8 and sleeve 81 on which the bowsprings are mounted in the downstream direction also. As can be seen from FIG. 12, if the sleeve 81 moves in the downstream direction, the lip of the groove 84 is brought to bear against the canted coil spring 85 causing the coils of the spring to compress. The canted coil spring will continue to be compressed until the raised lip of the groove 84 can slide though the interior of the spring. The result is that the sleeve 81 and mandrel 3 move downstream extending the separation between the connection points 7 and 8 for the bowsprings 6 and causing the bowsprings 6 and the valve membrane 5 to be pulled towards the tool. The enlarged gap between the valve membrane 5 and the inner surface of the borehole allows more fluid to flow externally around the membrane and therefore allows the fluid pressure to equalise.

In order to reset the mechanism, all that is required is for the actuator rod 71 to be operated to stow the bowspring arms 6. This moves the bush 7 in the upstream direction causing the bowsprings to be pulled further into the tool body. As the bowsprings 6 are pulled inwards, they pull the valve membrane 5 and mandrel 3 upstream and against the canted coil spring 85 until the spring 85 can snap back into the groove 84. The compressive force from ball spring 88 assists in this process. At this juncture, the bowsprings may be seen to jump back out towards the borehole as for an instant the separation between the end points 7 and 8 is decreased. Once the safety mechanism is reset, reversing the direction of the actuator is possible once again to extend the bowsprings for further use. The action of the actuator rod 71 is then to push the housing 82 against the collar 81 so that the two mandrel sections 3 and 83 move together.

Being able to reset the safety mechanism downhole, using the same mechanism as required to operate the bowsprings, provides a significant advantage, as testing of the borehole can continue without having to retrieve the tool. The mechanism also prevents the valve membrane from tearing if the casing diameter is too large and the arms over-extend.

In alternative examples of the invention the valve mechanism may be implemented differently. For example, the valve may comprise a rotatable section of mandrel on which the tubular, narrower section of the valve sleeve is disposed. To close the valve, the mandrel section is rotated so that the fluid flow through the valve sleeve is pinched off, much like a tourniquet.

Alternatively, the valve could be provided as an actuable plug that fits into a reinforced end of the tubular narrower section to stem the flow.

Thus a reliable modulator for use in injection and casing wells has been described. The modulator device described means that there is no need for modulators to be built into structure of the well, wellhead, or line connecting the well, and obviates the need for a pump or duse. Further, as all components of the modulating mechanism are part of the tool, its operation does not depend on proximity of the tool to an unknown surface. In particular, the casing wall is not part of the modulation mechanism itself. The sealing aspect does of course require cooperation with such as surface but once the seal is in place, the modulation is effected purely by the valve and the valve sleeve.

The invention has been described with reference to example implementations, purely for the sake of illustration. The invention is not to be limited by these, as many modifications and variations would occur to the skilled person. The invention is to be understood from the claims that follow.

The invention claimed is:

1. An apparatus for downhole use in a fluid-filled well, the apparatus comprising:

a longitudinal tool body;

a plurality of extendable arms mounted on the tool body for opening and closing within the fluid-filled well;

a flexible valve sleeve attached to the plurality of extendable arms and moveable between a stowed position and an unstowed position by movement of the extendable arms, wherein in the unstowed position the valve sleeve is arranged to receive a flow of fluid from the well and the pressure of the fluid in the valve sleeve causes at least a portion of the valve sleeve to seal against a wall of the well, and wherein in the unstowed position, the valve sleeve causes the flow of fluid to exit a downstream end of the valve sleeve such that the diameter of the flow of fluid upon exiting the valve sleeve is greater than a diameter of the longitudinal tool body;

wherein the flexible valve sleeve has at least a first tapered section, a first end of the tapered section of the sleeve having a first diameter and a second end of the tapered section having a second diameter, the first diameter being greater than the second diameter and greater than an anticipated internal diameter of the well, and wherein the first tapered section is attached to the extendable arms, such that in use the portion of the valve sleeve that seals against the wall of the well is intermediate the first and second diameters.

2. The apparatus of claim 1, wherein the valve sleeve is non-porous substance.

3. The apparatus of claim 1, wherein the valve sleeve is made of a reinforced material.

4. The apparatus of claim 1, comprising a plurality of constant force springs, each spring slideably mounted at one end on the tool body and attached at the other to the periphery of the first tapered section of the valve sleeve having the first diameter, wherein the slideably mounted constant force springs are concentrically mounted such that by sliding in one direction they push the periphery outwards from the tool body, and by sliding in the other they draw the periphery in towards the tool body.

5. The apparatus of claim 4, comprising releasable connectors for connecting the valve membrane to the extendable arms.

6. The apparatus of claim 5, wherein the releasable connectors are connected to the constant force springs at a location intermediate the ends of the constant force springs.

7. A modulator apparatus for downhole use in a fluid-filled well, the modulator comprising:

the apparatus of claim 1;

a valve for modulating the pressure of the fluid in the fluid-filled well by at least partly closing one end of the valve sleeve to restrict the flow of fluid.

8. The modulator apparatus of claim 7, wherein the valve comprises:

a valve seat mounted on the tool body;

one or more valve members for closing against the valve seat to at least partly stop the flow of fluid in the valve sleeve.

9. The modulator apparatus of claim 8, comprising an actuator for operating the one or more valve members to close onto the one end of the valve sleeve and press it against the valve seat.

10. The apparatus of claim 9, wherein the valve sleeve has a second substantially tubular section joined at one end to the first tapered section at the end with second diameter, and joined at the other end to the one or more valve members.

11. The modulator apparatus of claim 8, wherein the valve seat has a number of ridges arranged radially around the tool body, and the valve members are arranged to cooperate with the ridges on closing.

12. The modulator apparatus of claim 8, wherein the valve seat is made of resiliently compressible material.

13. The apparatus of claim 8, wherein the tool body comprises an over-pressure release mechanism, the over pressure release mechanism comprising:

a telescopic section of the tool body, a tool body housing for receiving the telescopic section;

wherein one end of each arm in the plurality of extendable arms is mounted on the telescopic section of the tool body, and the other end is mounted on the tool body housing;

a retention mechanism for retaining the telescopic section in a retracted position in the housing, wherein the retention mechanism can be overcome by a force acting on the valve sleeve and through the plurality of extendable arms.

14. The apparatus of claim 13, comprising a spring biasing the telescopic section to remain in the tool body housing.

15. The apparatus of claim 13, wherein the retention mechanism comprises a groove on one of the telescopic section or tool body housing and a restriction on the other of the telescopic section or tool body housing; and a deformable ring received in the groove.

16. The apparatus of claim 15, wherein the deformable ring is a canted coil spring.

17. A modulator apparatus for downhole use in a fluid-filled well, the modulator comprising:

a tool body;

a valve for modulating the pressure of the fluid in the fluid-filled well, the valve having a valve seat disposed on the tool body and one or more valve members for closing against the valve seat;

a retractable fluid flow channel for at least partly sealing against the wall of the fluid-filled well and for channeling the fluid in the fluid-filled well to the valve; and a flexible valve sleeve attached to the plurality of extendable arms and moveable between a stowed position and an unstowed position by movement of the extendable arms, wherein in the unstowed position, the valve sleeve causes a flow of fluid to exit a downstream end of the valve sleeve such that the diameter of the flow of fluid upon exiting the valve sleeve is greater than a diameter of the tool body;

wherein the flexible valve sleeve has at least a first tapered section, a first end oldie tapered section of the sleeve having a first diameter and a second end of the tapered section having a second diameter, the first diameter being greater than the second diameter and greater than an anticipated internal diameter of the well, and wherein the first tapered section is attached to the extendable arms, such that in use the portion of the valve sleeve that seals against the wall of the well is intermediate the first and second diameters.

18. The modulator apparatus of claim 17, wherein the fluid flow channel has a diameter that tapers from an end distal to the valve to an end proximate the valve.

19. The modulator apparatus of claim 18, wherein the retractable fluid flow channel comprises:

a plurality of extendable arms mounted on the tool body for opening and closing within the fluid-filled well;

a flexible valve sleeve attached to the plurality of extendable arms and moveable between stowed position and an unstowed position by movement of the extendable arms, wherein in the unstowed position the valve sleeve is arranged to receive a flow of fluid from the well and the pressure of the fluid in the valve sleeve causes at least a portion of the valve sleeve to seal against a wall of the well.

20. The modulator apparatus of claim 19, comprising art actuator for operating the one or more valve members to close onto the one end of the valve sleeve and press it against the valve seat.

21. The modulator apparatus of claim 20, wherein the valve seat has a number of ridges arranged radially around the tool body, and the valve members are arranged to cooperate with the ridges on closing.

22. The modulator apparatus of claim 21, wherein the valve seat is made of resiliently compressible material.

23. A tool string comprising the apparatus of claim 17.

* * * * *